US006789476B2

(12) United States Patent
Langsch

(10) Patent No.: US 6,789,476 B2
(45) Date of Patent: Sep. 14, 2004

(54) ROTARY BODY FOR COMPENSATING FANOUT

(75) Inventor: Robert Langsch, Ortschwaben (CH)

(73) Assignee: Maschinenfabrik Wifag, Bern (CH)

( * ) Notice: Subject to any disclaimer, the term of this patent is extended or adjusted under 35 U.S.C. 154(b) by 0 days.

(21) Appl. No.: 10/455,122

(22) Filed: Jun. 5, 2003

(65) Prior Publication Data

US 2003/0226457 A1 Dec. 11, 2003

(30) Foreign Application Priority Data

Jun. 6, 2002 (DE) ..... 102 25 200

(51) Int. Cl.[7] ..... B41F 13/02
(52) U.S. Cl. ..... 101/228; 101/219; 492/30
(58) Field of Search ..... 101/216, 219, 101/228, 494, 483; 492/30

(56) References Cited

U.S. PATENT DOCUMENTS 1,630,911 A * 5/1927 Wentz ..... 601/127
2,266,859 A * 12/1941 Grampp ..... 601/118
3,867,749 A * 2/1975 Betz ..... 492/32
5,042,383 A * 8/1991 Wirz ..... 101/420
6,550,384 B1 4/2003 Langsch ..... 101/225

FOREIGN PATENT DOCUMENTS

EP 1 101 721 A1 5/2001
SU 960335 A * 9/1982 ..... D06H/07/04

* cited by examiner

*Primary Examiner*—Daniel J. Colilla
(74) *Attorney, Agent, or Firm*—McGlew and Tuttle, P.C.

(57) ABSTRACT

A rotary body for compensating the fanout in a printing press. The rotary body forms alternatingly foot sections and head sections projecting over the foot sections by radial height differences along an axis of rotation. The rotary body is a torsion-proof connection of parts or is a one piece structure. The radial height differences increase in the circumferential direction from minima, which they have along a first straight line offset in parallel to the axis of rotation, to maxima, which they have along a second straight line offset in parallel to the axis of rotation.

28 Claims, 6 Drawing Sheets

ROTARY BODY FOR COMPENSATING FANOUT

FIELD OF THE INVENTION

The present invention pertains to a rotary body, which is used to compensate the fanout in a printing press or is provided, still outside the printing press, for installation for the purpose of fanout compensation. The printing press is a machine that prints according to the wet method, preferably with the use of a moistening agent. Offset printing shall be mentioned here as an example in particular. The printing press may be a newspaper printing press for printing large newspaper runs. The web is preferably guided as an endless web through the machine and is wound off from a roll, i.e., the printing press is a web-fed printing press and especially preferably a web-fed rotary printing press in such an embodiment.

BACKGROUND OF THE INVENTION

Changes occur in lateral expansion in printing presses because of the liquid having penetrated the web. This phenomenon, known as fanout, has the undesired consequence that the width of the web measured at right angles to the direction of conveying of the web changes between two printing gaps in which the web is printed on one after another. Even though the fanout phenomenon may be caused, in principle, by the ink that alone has penetrated, the fanout is significant in practice especially in the case of printing operating with moistening agent because of the moistening of the web which is associated with it. The web moistened in the upstream printing gap along the web swells on its way and becomes wider in the next printing gap of the two printing gaps, which is located downstream along the web. This leads to printer's errors in the transverse direction of the web unless measures are taken to compensate the change in width.

EP 1 101 721 A1 shows devices for compensating the fanout for the web-fed rotary printing, with which the web is deformed in a wave-shaped pattern at right angles to its direction of conveying before it runs into a next printing gap, in which it is printed on. The width of the web is corrected, i.e., compensated in such a way that it is adapted in advance to the change in width that is to be expected based on the fanout. Since the extent of the change in width that can be attributed to the fanout may change from one run to the next and even within one run when the paper is changed because of different paper grades, EP 1 101 721 A1 also describes, among other things, adjustable fanout compensators, with which the amplitude of the imposed wave shape of the web can be changed in a specific manner. An increase in the amplitude brings about a reduction in the width of the web. The described embodiments of adjustable fanout compensators are formed by a plurality of bodies each, which are arranged along an axis of rotation of the compensator in question alternatingly next to one another and form, corresponding to the desired wave shape of the web, radially projecting head sections and setback foot sections, which are adjustable in relation to one another in order to adapt the extent of the projection and setback of the sections in adaptation to the extent of the change in width that can be attributed to the fanout. However, the prior-art devices, which proved to be successful per se, are complicated and therefore lead to a comparatively high initial cost.

Furthermore, EP 1 101 721 A1 also discloses a fanout compensator that is designed as a rotary body in one piece.

This comparatively simple compensator has proved to be successful in practice. However, adaptation to changing run conditions is possible with such a compensator only by keeping ready a plurality of different rotary bodies, which are stored in the printing press in, e.g., a changing frame and can be introduced into or removed from the print run by an adjusting movement of the changing frame.

SUMMARY OF THE INVENTION

The object of the present invention is to also make possible the compensation of a change in the width of a web to be printed on, which change can be attributed to the fanout in adaptation to different run conditions in a simple and inexpensive manner.

The present invention pertains to a rotary body, which is provided for compensating the fanout in a printing press or is already installed in the press in order to guide a web to be printed on, which wraps around the rotary body. The wrapping angle should be at least 3°. However, a wrapping angle of 5° or more, e.g., 10°, is preferred. The wrapping angle may reach up to 180°. The rotary body is intended for being mounted rotatably around an axis of rotation, which extends through the rotary body. Along the axis of rotation, the rotary body forms head sections and foot sections alternatingly next to each other. The surface sections formed by the head and foot sections form the jacket surface of the rotary body. The head sections project over the foot sections radially to the axis of rotation by height differences. Even though the wave contour thus obtained in the axial direction may, in principle, contain jumps, it is preferably continuous. It is especially preferably continuously differentiable and curved in the axial direction, insofar as this can be achieved with the manufacturing methods available in practice at an economically acceptable price. If arc sections with curvatures, which are different, or arc sections with straight axial sections meet, the wave contour may have kinks. Such kinks should be machined such that they have an obtuse angle or are even more preferably round.

According to the present invention, the head and foot sections are not rotatable in relation to one another around the axis of rotation because they are either fitted together and connected to one another in a torsion-proof manner, or they are formed by the rotary body in one piece. Even though examples of such rotary bodies with a wave profile have been known, in principle, from EP 1 101 721 A1, the present invention combines the feature of the torsion-proof connection or, more preferably, the one-piece design with the advantage of adjustability because the radial height differences existing between the head sections and the foot sections increase from minima, which they have along a first straight line offset in parallel to the axis of rotation, to maxima in the circumferential direction around the axis of rotation. The height differences preferably increase monotonically in the circumferential direction. The height differences show the maxima along a second straight line offset in parallel to the axis of rotation. The first straight line and the second straight line are preferably tangents to all head sections, namely, if all head sections have the same radial height in relation to the axis of rotation. If this is not the case, the two straight lines are the tangents to the head section projecting the farthest or to the group of head sections projecting the farthest. A rotary movement around the axis of rotation that is uniform for the entire rotary body is sufficient for the adjustment of the rotary body.

In one preferred embodiment, the height differences assume their maxima along a single straight line. However, it is also possible, in principle, for the maxima to be assumed not only along exactly one straight line, but in an area extending over a certain arc length around the axis of rotation. This may, in principle, also apply in relation to the minima.

The rotary body according to the present invention can be mounted in the printing press in a simple manner and can be mounted rotatably in the same manner as other rotary bodies of the printing press, e.g., deflecting rollers. The assembly of parts that can be adjusted in relation to one another, as in the prior-art, adjustable fanout compensators, is not necessary.

Even though the one-piece design over the entire width of the web is clearly preferred, a fanout compensator is also advantageous that is formed by arranging a few one-piece rotary bodies, e.g., two rotary bodies, next to each other along their common axis of rotation. Compared to a rotary body from individual bodies assembled in a torsion-proof manner, which form a head section or foot section each and are likewise still the subject of the present invention, the assembly from optionally two or three rotary bodies with a wave profile is markedly simpler.

The radial height differences by which the head sections project over the foot sections increase monotonically from their minima in the circumferential direction preferably in both directions of rotation. More preferably, they increase continuously in both directions of rotation. It is most favorable if they increase uninterruptedly continuously in both directions of rotation, which mathematically means that the radial height differences plotted as a function of the angle of rotation are continuously differentiable functions of the angle of rotation. The height differences increase especially preferably linearly or at least approximately linearly with the angle of rotation.

Corresponding to preferred embodiments, the surface sections formed by the head sections have the same shape. The equality of the shape of the surfaces is also preferred for the foot sections. The surfaces of the head sections and/or the surfaces of the foot sections should form circles in any cross section along the axis of rotation. However, other surfaces, which are round around the axis of rotation everywhere, are also advantageous. Should kinks develop in the circumferential direction around the axis of rotation due to a manufacturing process, the round arc pieces meeting each other at the kinks should join each other possibly at obtuse angles, which should equal at least 120°. However, it is more advantageous to avoid kinks or even jumps in the circumferential direction even for the rotary bodies obtained according to such manufacturing methods by making the kinks or even jumps round by a suitable finishing, e.g., grinding and polishing.

A fanout compensator, which is arranged at a suitable site on the path of the web between two printing gaps, comprises the rotary body according to the present invention, a rotary mount, in which the rotary body is mounted rotatably around its axis of rotation, and a control or regulating device with a final control element for generating a rotary adjusting movement of the rotary body around its axis of rotation. The rotary adjusting movement is a rotary movement, by which the rotary body is rotated around its axis of rotation from a first angle of rotation position, in which the web is wrapped around the rotary body symmetrically in relation to a first wave contour, into another, second angle of rotation position, in which the web is wrapped around the rotary body symmetrically in relation to a differently shaped, second wave contour. One of the wave contours may be a straight line, namely, if the minimal height differences are "zero."

In one variant, the rotary body has fluid channels, which form a plurality of opening sites on its surface. The fluid channels are used in an especially advantageous fanout compensation process to admit fluid to the surface of the rotary body. The fluid is preferably a pressurized gas and may be especially compressed air. The fluid forms a fluid gap, a kind of fluid cushion, in the area wrapped by the web between the surface of the rotary body and the underside of the web facing it. The fluid gap prevents ink that adheres to the underside of the web and is not yet dried from being able to be transferred to the rotary body, which could lead to disturbances. Furthermore, the friction is reduced.

The fluid channels may be designed as holes and extend from their opening sites on the surface through the rotary body radially inwardly into one cavity or optionally into a plurality of cavities, by which they are connected to a fluid source. Such holes may be especially straight and unbranched.

Each of the fluid channels may be separated from each of the other fluid channels and form a single opening site each. However, the fluid channels or some of the fluid channels may also be branched off toward the outer jacket surface and form a plurality of opening sites each there. Thus, providing the rotary body as a whole or, in case of the design as a hollow body, at least its ring section forming the fluid channels with a porosity sufficient for guiding the fluid corresponds to a likewise preferred embodiment. The porosity is preferably open porosity, so that the pore channels formed by the material form the fluid channels. The original shaping by compression molding a powder, preferably a metal powder, with subsequent or simultaneous sintering of the molding is especially suitable for forming a porous rotary body or rotary body ring section. Fluid channels formed in two manners may also occur in the same rotary body, i.e., both pore channels and fluid channels prepared subsequently may be present in the same rotary body.

The opening sites of the fluid channels may be arranged in a uniformly distributed manner in the axial direction and in the circumferential direction over the surface of the rotary body. However, the density of the opening sites per unit area of the surface may vary periodically with the period of the head and foot sections in the axial direction while the distribution is preferably uniform in the circumferential direction. Thus, the surface density of the opening sites may be greater in the surface sections formed by the head sections than in the surface sections formed by the foot sections in order to compensate axial flows from the head sections into the foot sections.

The rotary body may be formed in the original shaping process in one piece in the shape according to the present invention or in a plurality of pieces, which are connected to one another in a torsion-proof manner, e.g., by the aforementioned compression molding and sintering of a powdered starting material. The starting material is preferably a powder of a metal or metal alloy, but may also be a powdered or granulated plastic, instead. If the rotary body is a plastic body, it is possible to shape this rotary body as an injection-molded body according to the injection molding process, so that it is obtained as an injection-molded body.

Especially shaping, e.g., drop-forging, may be considered for use as the manufacturing process to obtain a preferably continuously differentiable, three-dimensional wave shape, which is ideally round everywhere, in the case of a metallic rotary body.

In another, especially simple manufacturing process, a rotary body, which is rotationally symmetrical in relation to a single longitudinal symmetry axis, is formed in a first step. The jacket surface of such a one-piece starting body may have especially a regular wave shape with foot sections that form identical surface sections each, and with head sections that likewise form identical surface sections. The rotary body according to the present invention is obtained from the starting body by machining with a tool. The tool may be, e.g., a milling head, a linear roughing, grinding and polishing tool or preferably a turning tool. During the removal of material, the starting body and the tool perform a rotary movement in relation to one another around a machining axis that is eccentric to the longitudinal symmetry axis of the starting body, i.e., is offset in parallel. The tool may be rotated around the stationary starting body, or both the starting body and the tool may be rotated around the machining axis in relation to one another. The starting body may likewise be driven to perform a rotary movement around the machining axis for the material-removing machining, while the tool does not perform any rotary movement in relation to a frame of the machine tool in which the starting body is clamped. The radial distance between the tool and the machining axis is reduced during the relative rotary movement for the material-removing machining. This advantageously takes place due to the tool being moved radially in a straight line toward the machining axis. The distance is reduced until the tool has reached the first straight line along which the radial height differences between the foot sections and the head sections are "zero." An oversize, which may be left after the removal of material and is then subsequently removed by fine surface finishing, shall be ignored here.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
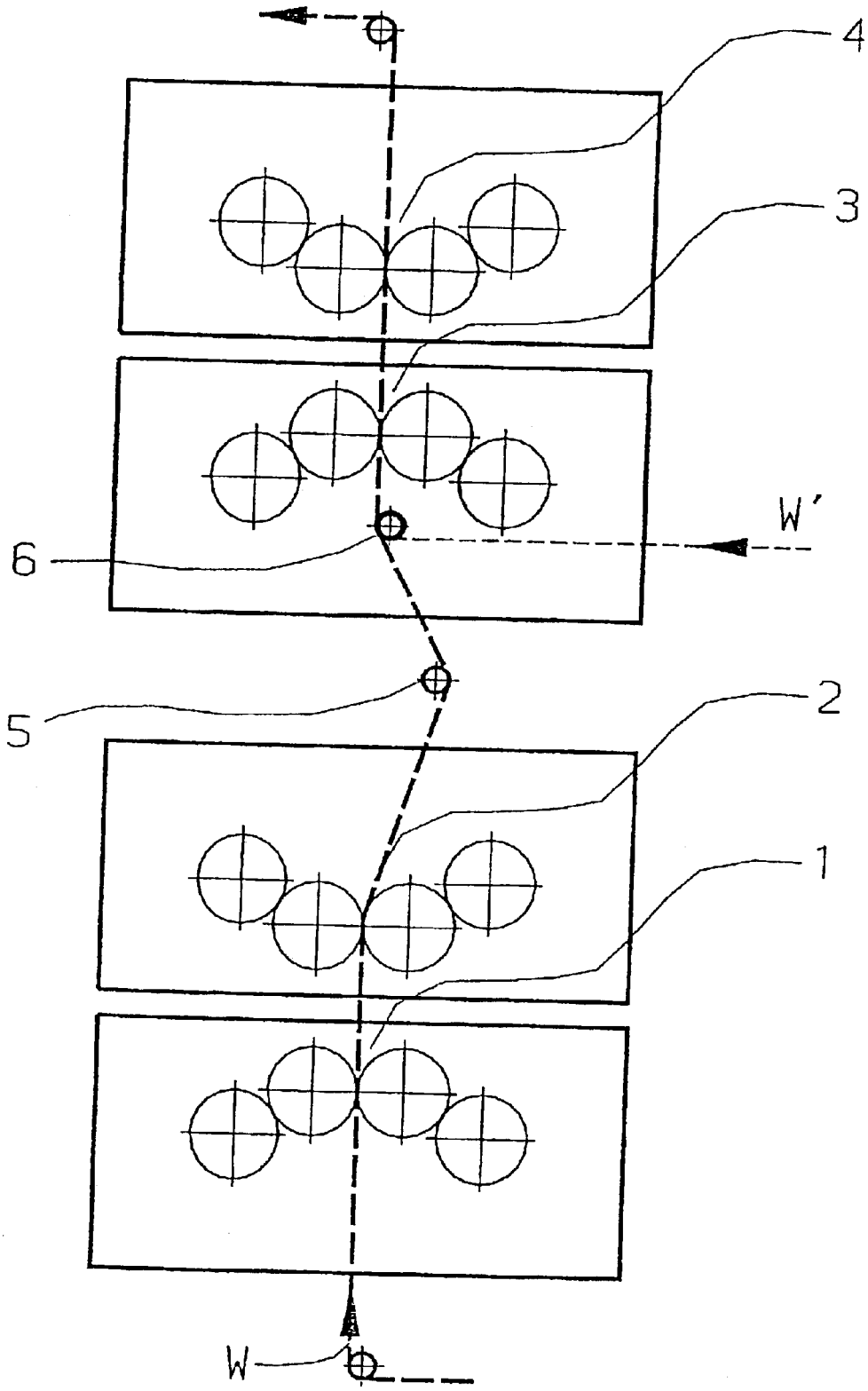
FIG. 1 is a schematic view showing a printing tower with a rotary body according to the present invention.

Referring to the drawings in particular, FIG. 1 shows an eight-up tower with four printing couples. The four printing couples are arranged in the printing tower one on top of another in two H bridges. Each of the printing couples comprises two rubber blanket cylinders and two plate cylinders, i.e., a plate cylinder each for one of the rubber blanket cylinders. The rubber blanket cylinders form between them printing gaps 1 through 4, through which a web W is conveyed and is printed on on both sides by the rubber blanket cylinders pressing them. An intake roller is arranged in the known manner in front of the printing couple that is the first printing couple in the direction of conveying, and a discharge roller is arranged in the known manner behind the printing couple that is the last printing couple in the direction of conveying, and the rollers may be designed as draw rollers in order to set a certain web tension.

The web W is printed on according to the wet offset method. The web W now takes up moisture and swells. Without corrective measures, the web width measured at right angles to the direction of conveying of the web W would increase from one printing gap to the next, and the prints printed one after another in the printing gaps 1 through 4 would not fit each other in the transverse direction of the web, i.e., register mark errors would develop in the transverse direction. This phenomenon is called "fanout." The increase in width would be greatest between the two H bridges, i.e., between the printing gaps 2 and 3, because the path from gap to gap is longer there than between two printing gaps of one bridge.

To prevent or at least reduce register mark errors in the transverse direction, the web width is reduced on the path of the web W from the printing gap 2 to the printing gap 3 directly following it in the printing run being shown. A fanout compensator is arranged for this purpose between the printing gaps 2 and 3. The fanout compensator comprises a rotary body 6, which may also be used as a deflecting roller at the same time. The rotary body 6 is arranged directly in front of the printing gap 3 and also assumes the straight guiding function for the web W in this arrangement, so that the web W runs into the printing gap 3 without wrapping.

FIG. 1 also indicates an alternative print position, in which the web W is guided only through the two lower printing gaps 1 and 2, while another web W' is guided over the rotary body 6 and runs straight into the next printing gap 3 after deflection.

The rotary body 6 is roller-shaped, but, unlike a simple, smooth roller, it has a surface waved in the longitudinal direction. Wrapping and the web tension ensure that the web is deformed corresponding to the surface wave pattern of the rotary body 6 and the width of the web is reduced as a result.

The wrapping around the rotary body 6 is ensured by a deflecting roller 5, via which the web W is guided to the rotary body 6 at an angle to the straight connection line between the rotary body 6 and the next printing gap 3. Additional deflecting means are not necessary in the alternative print run, in which the web W' already runs at an angle to this straight connection line and the rotary body 6 also acts as a deflecting roller in a dual function.

Figure 2:
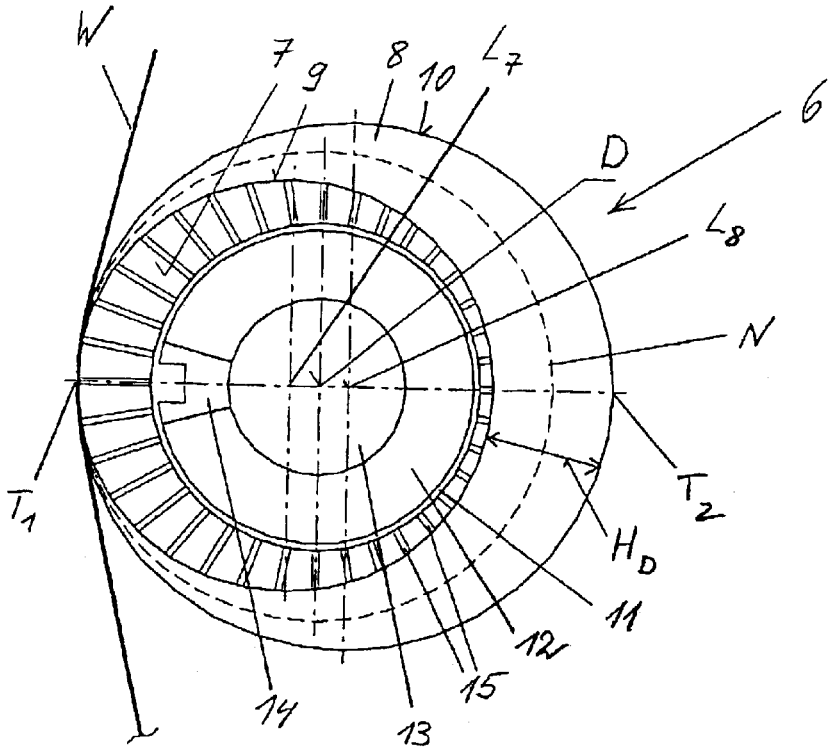
FIG. 2 is a cross sectional view of the rotary body according to a first exemplary embodiment in a first angle of rotation position.
Figure 3:
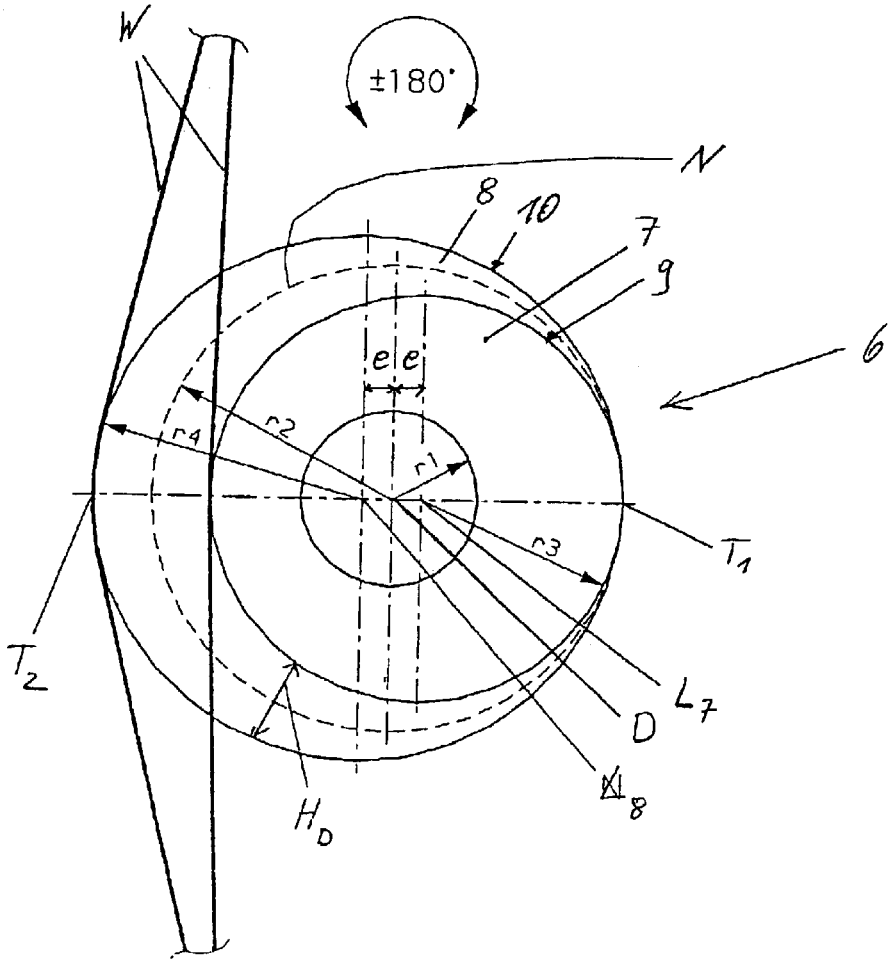
FIG. 3 is a cross sectional view of the rotary body in a second angle of rotation position.
Figure 4A:
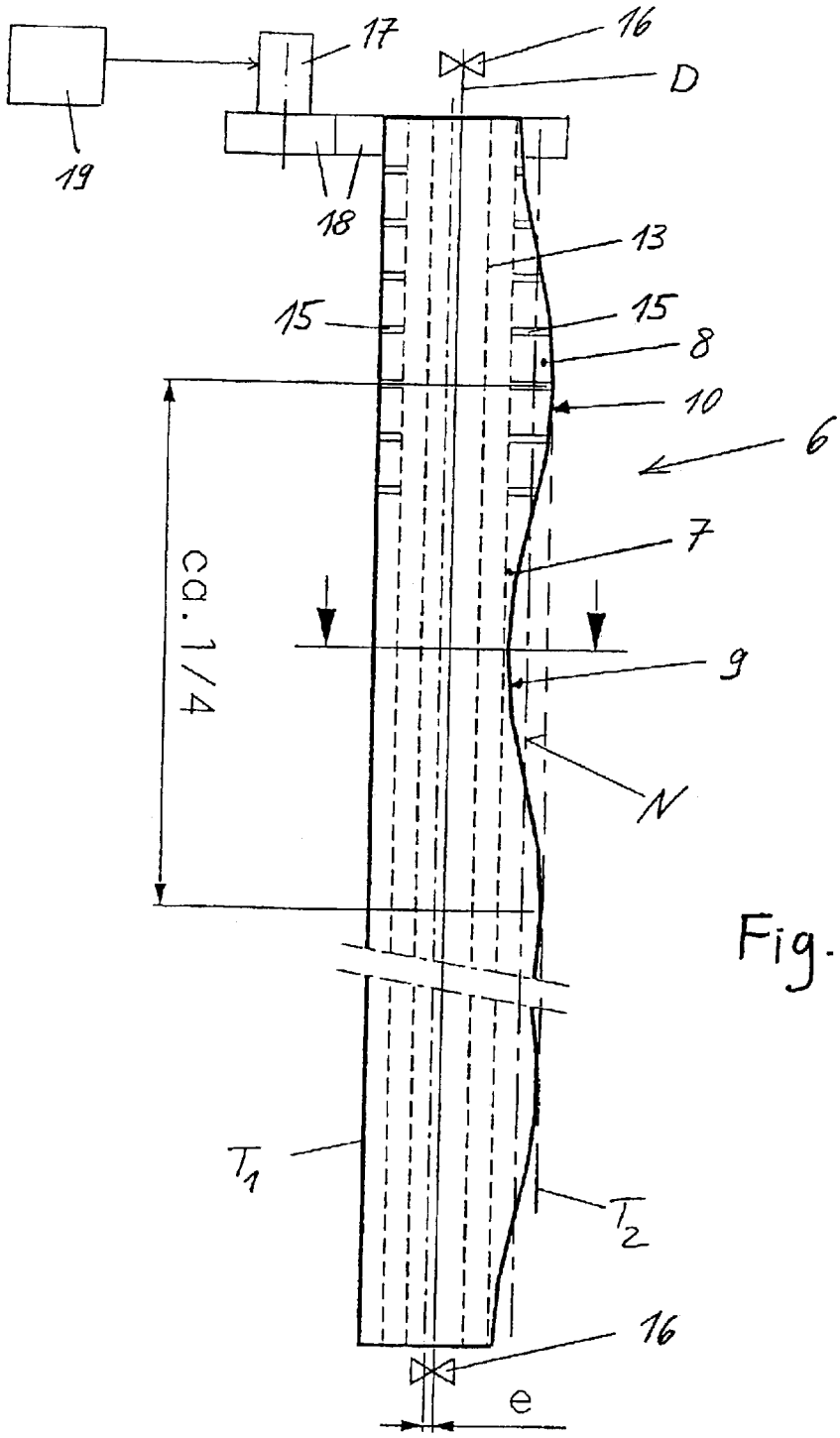
FIG. 4A is a longitudinal view and a partial longitudinal sectional view of the rotary body.
Figure 4B:
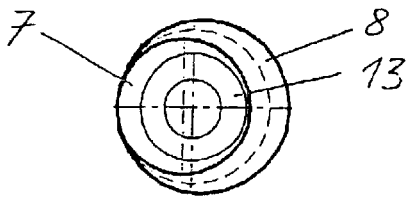
FIG. 4B is a cross sectional view of the rotary body.

FIGS. 2 and 3 show the rotary body 6 in identical cross sections but in two extreme angle of rotation positions. FIGS. 4A and 4B show the rotary body in a longitudinal view and partially in a longitudinal section.

The rotary body 6 is mounted in a frame of the printing press rotatably around a longitudinal axis D. The longitudinal axis D is therefore hereinafter called the axis of rotation. The rotary body 6 is shaped in one piece according to an original shaping or forming process and fine machined on the surface, preferably only subjected to uniform smoothing. The rotary body 6 is not rotationally symmetrical in relation to the axis of rotation D.

As can be recognized from viewing FIGS. 2 through 4 together, the surface of the rotary body 6 forms a straight line $T_1$ parallel to the axis of rotation D at a single value of an angle of rotation around the axis of rotation D. At all other angles of rotation, the surface has a wave shape with a sinusoidal wave contour rounded uniformly in the axial direction. The axial sections of the rotary body 6 that form the wave valleys will hereinafter be called foot sections 7, and the axial sections 8 that form the wave peaks will hereinafter be called head sections 8. Beginning from the straight line $T_1$, the radial height difference $H_D$ of the wave contour increases continuously in the circumferential direction around the axis of rotation D in both directions of rotation up to a second straight line $T_2$. The straight lines $T_1$ and $T_2$ are located diametrically opposite each other in relation to the axis of rotation D, i.e., the straight lines $T_1$ and $T_2$ extend in one plane with the axis of rotation D. The radial height difference $H_D$ is the amplitude of the wave contour. The radial height differences $H_D$ amount to 4 mm along the second straight line $T_2$. These maximum height differences, which are equal in the exemplary embodiment, should be at least 2 mm and at most 10 mm.

The straight lines $T_1$ and $T_2$ are tangents to the head sections 8, i.e., they touch the head sections 8 precisely in their apices. They originate from a straight enveloping cylinder enveloping the head sections 8. If the tangent $T_1$ to the surface of the enveloping cylinder is displaced in parallel, the height difference $H_D$, which is measured radially to the axis of rotation D between the apices of the foot sections 7 and the apices of the head sections 8, increases continuously until the tangent $T_2$ is reached.

A regular cylinder jacket surface N, behind which the foot sections 7 are set back radially and over which the head sections 8 project radially, is also shown in FIGS. 2 through 4. The cylinder surface N divides the surface profile in each longitudinal section into the foot sections 7 and the head sections 8.

The foot sections 7 form surface sections 9, and the head sections 8 form surface sections 10. The surface sections 9 and 10 are rounded in the axial direction and in the circumferential direction, and they are preferably curved continuously everywhere. They run tangentially into one another in the cylinder surface N, so that a uniform wave shape with continuous, i.e., continuously differentiable transitions between the surface sections 9 and 10 is obtained everywhere in the axial direction.

The surface of the rotary body 6 forms a circle in the cross section everywhere along the axis of rotation D. In FIG. 3, the radius of the circle is designated by $r_3$ in the apices of the foot sections 7 and by $r_4$ in the apices of the head sections 8. The central axes of these azimuths, which are designated by $L_7$ and $L_8$, are eccentric to the axis of rotation D with the eccentricity "e." The central axes $L_7$ and $L_8$ extend in the same plane as the axis of rotation D. The central axes of the cross section circles of the foot sections 7 and also the central axes of the cross section circles of the head sections 8 gradually migrate in the direction of the axis of rotation D with the approach to the neutral cylinder surface N to coincide with the axis of rotation D at the transition sites on the neutral cylinder surface N.

It should also be noted in regard to the neutral cylinder surface N and the radial height difference $H_D$ that the arcs formed by the surface sections 8 along each of the straight lines of the neutral cylinder surface N, which straight lines are parallel to the axis of rotation D, are exactly as long as the arcs formed by the surface sections 10. These arcs of the surface sections 8 and 9 are especially preferably equal when the arcs of the surface sections 8 are folded to the side of the respective straight line of the cylinder surface N on which side the arcs of the surface sections 10 extend. This is the case in the exemplary embodiment. The tangent $T_1$, along which the radial height difference $H_D$ has the value "0," extends in the neutral cylinder jacket surface N. As a result, a mean web path does not change when the rotary body 6 performs a rotary adjusting movement around the stationary axis of rotation D, e.g., from the angle of rotation position of minimum waviness shown in FIG. 2 into the angle of rotation position of maximum waviness shown in FIG. 3. In each angle of rotation position of the rotary body 6, the mean path of the web W extends on the neutral cylinder surface N, which is called "neutral" for this reason.

The rotary body 6 is a hollow body with a central, regular cylindrical hole 11 extending over its entire length. A hollow axle 12 fastened nonrotatably to the machine frame extends through the hole. The rotary body 6 is mounted rotatably on the hollow axle 12 around the axis of rotation D. The fixed mounting of the hollow axle 12 is designated by 16 in FIG. 4. The rotary adjusting movement of the rotary body 6 in relation to the hollow axle 12 is brought about by a motor by means of an electric motor 17, which rotates the rotary body 6 via a reducing gear mechanism 18. The motor 17 is the final control element of a control 19, which controls the final control element 17 for the adjustment of the rotary body 6, e.g., as described in EP 1 101 721 A1, to which reference is made here in this respect.

The rotary body 6 is adjusted rotatingly only for the purpose of adjustment, i.e., to change its surface contour acting on the web W. It is otherwise locked by the final control element 17 in the current print run via the gear mechanism 18.

A central, axial hole 13, which is used to feed compressed air to the rotary body 6, is formed continuously in the hollow axle 12. Furthermore, the hollow axle has a longitudinal opening 14. The rotary body 6 is provided with fluid channels 15, which extend radially through the ring jacket of the rotary body 6. Each of the fluid channels 15 is formed as a straight through hole, which extends into the inner cavity formed by the hole 11 and opens on the outer jacket surface of the rotary body 6, i.e., on the surface of the rotary body. The fluid channels 15 are arranged in a uniformly distributed pattern around the axis of rotation D of the rotary body 6 in the circumferential direction. They may be prepared in the ring jacket of the rotary body 6 by means of, e.g., a laser. The fluid channels 15 are also arranged in a uniformly distributed pattern along the axis of rotation D.

The fluid channels 15 are connected to a compressed air source via the hollow axle 12. The compressed air is introduced into the hole 13 of the hollow axle 12 and reaches the hole 11 and the fluid channels 15 via the longitudinal opening 14. The longitudinal opening 14 extends over a length that is sufficient to supply the fluid channels 15 with the compressed air uniformly over the entire axial length of the wave contour. The longitudinal opening 14 is widened from the hole 13 toward the outer jacket surface of the hollow axle 12 and covers a plurality of fluid channels 15 in the circumferential direction. It opens and widens in the direction of the underside of the wrapping web W. The compressed air thus reaches the area under the fluid channels 15, which are covered by the web W, directly radially through the hole 13 and the longitudinal opening 14. An annular gap formed between the hollow axle 12 and the inner jacket surface of the rotary body 6 preferably forms a sealing gap in order to minimize the loss of compressed air due to leakage.

Figure 5:
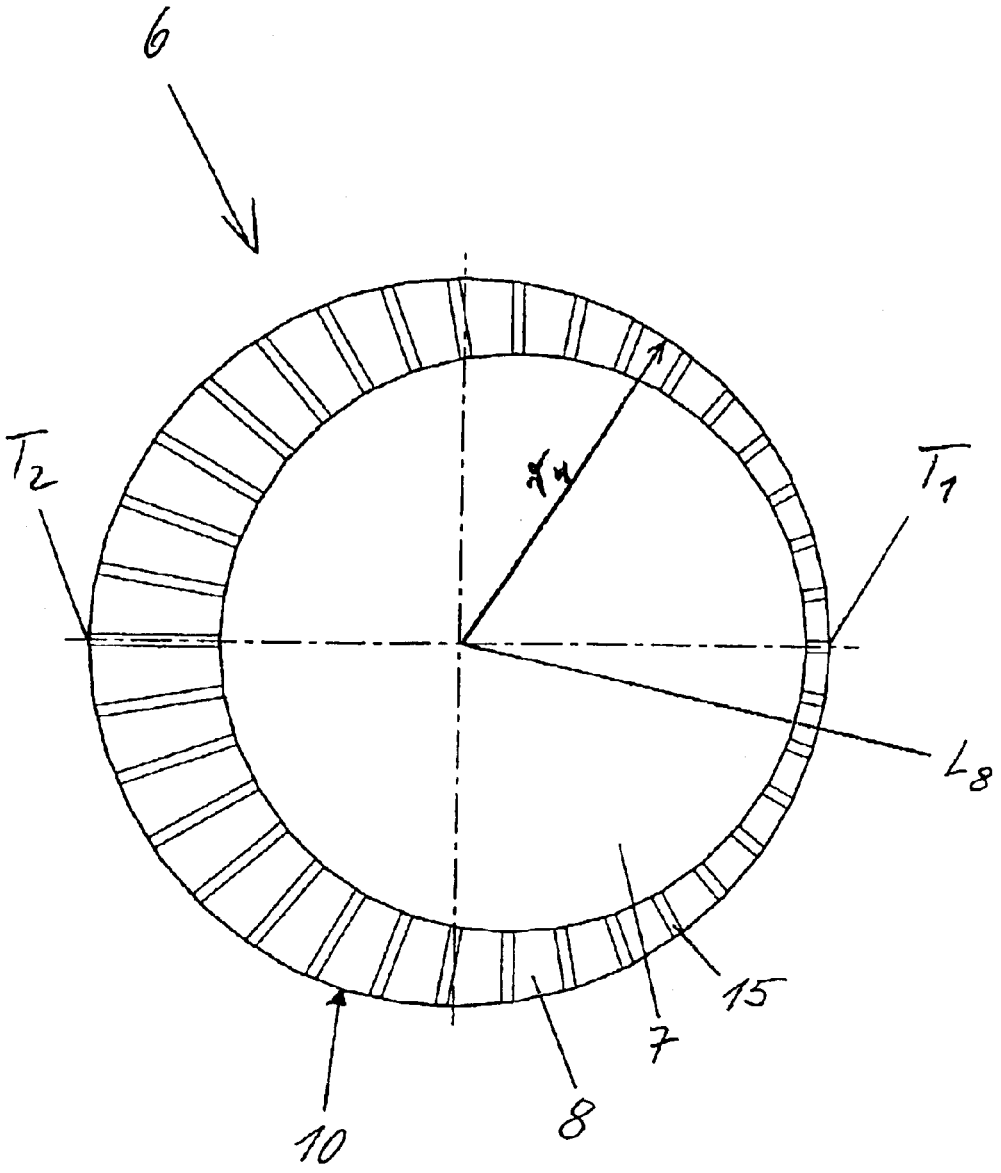
FIG. 5 is a cross sectional view through the apex of a head section of the rotary body.

Because of the cross-sectional plane selected, fluid channels 15 are shown in FIG. 2 only in the foot section 7 of the corresponding cross section. Fluid channels 15 are, of course, formed especially in the head sections 8, as can be recognized in the cross section through the apex of a head section 8 in FIG. 5.

Figure 6:
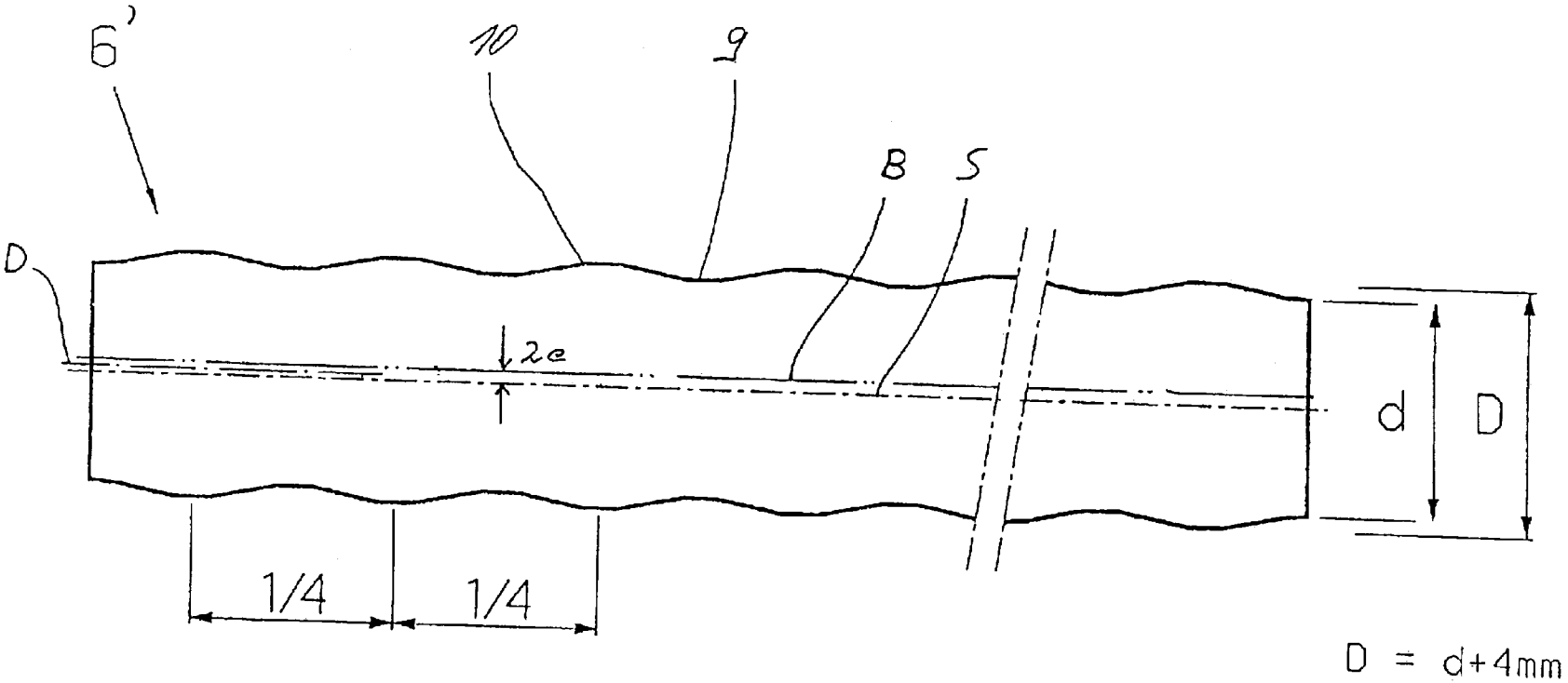
FIG. 6 is side view of a starting body, from which a rotary body according to a second exemplary embodiment is formed by material-removing machining.
Figures 7, 8, 9, 10, 11, 12, 13, 14:
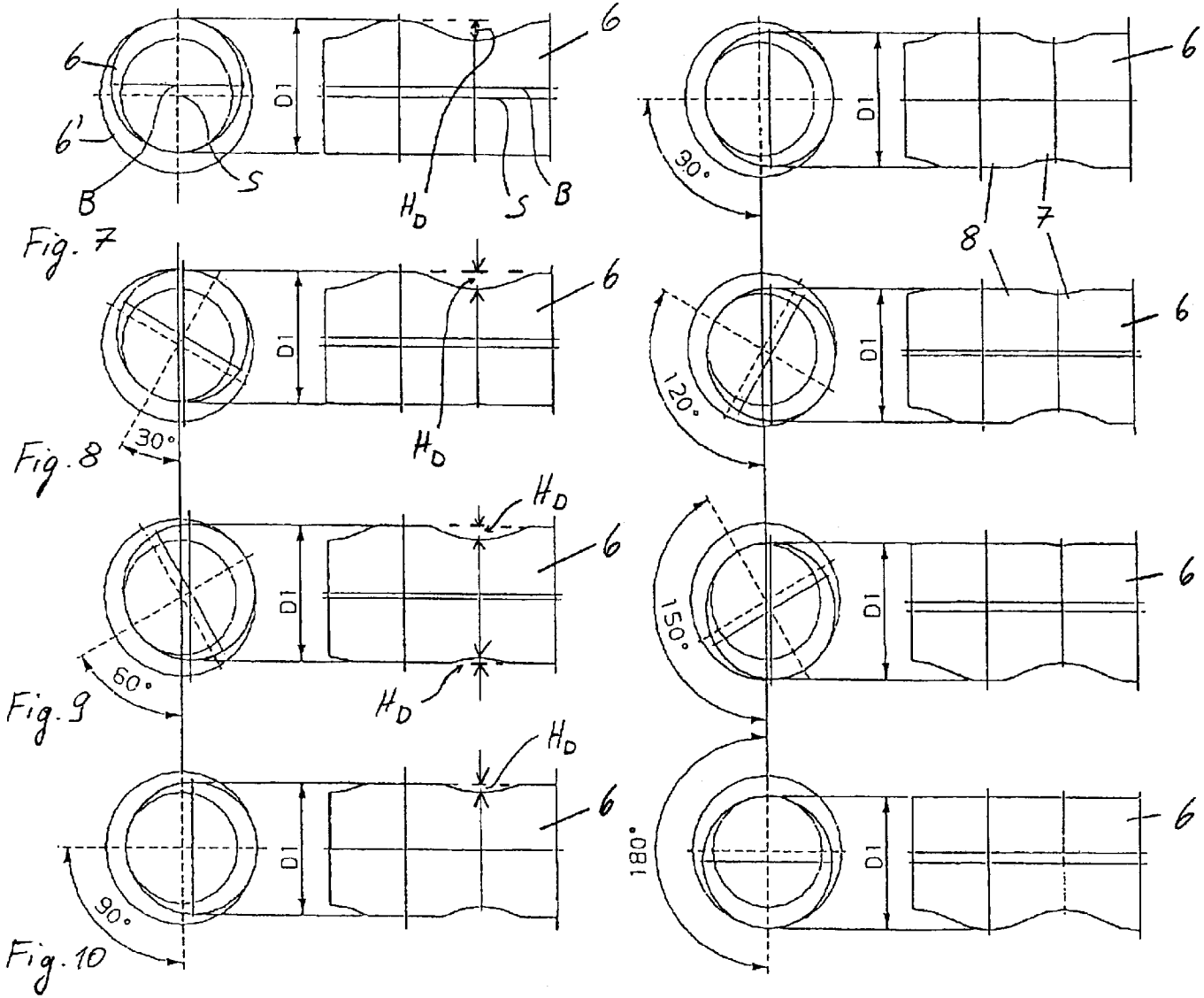
FIG. 7 is a composite end view and partial side view showing the rotary body of the second exemplary embodiment in an angular position.
FIG. 8 is a composite end view and partial side view showing the rotary body of the second exemplary embodiment in an angular position rotated 30° relative to FIG. 7.
FIG. 9 is a composite end view and partial side view showing the rotary body of the second exemplary embodiment in an angular position rotated 60° relative to FIG. 7.
FIG. 10 is a composite end view and partial side view showing the rotary body of the second exemplary embodiment in an angular position rotated 90° relative to FIG. 7.
FIG. 11 is a composite end view and partial side view showing the rotary body of the second exemplary embodiment in an angular position rotated 90° relative to FIG. 7.
FIG. 12 is a composite end view and partial side view showing the rotary body of the second exemplary embodiment in an angular position rotated 120° relative to FIG. 7.
FIG. 13 is a composite end view and partial side view showing the rotary body of the second exemplary embodiment in an angular position rotated 150° relative to FIG. 7.
FIG. 14 is a composite end view and partial side view showing the rotary body of the second exemplary embodiment in an angular position rotated 180° relative to FIG. 7.

FIGS. 7 through 14 show a rotary body 6 according to a second exemplary embodiment, which was obtained by machining from a starting body 6', which is rotationally symmetrical around its longitudinal axis and is shown in FIG. 6. FIGS. 7 through 14 show a view each of a front side of this rotary body 6 and a view of its longitudinal side. Based on FIG. 7, the figures show the rotary body 6 in a succession of angle of rotation positions, in which the rotary body 6 is rotated by 180° in increments of 30° from the first position shown in FIG. 7 into the position shown in FIG. 14. However, the angle of rotation position is the same in FIGS. 10 and 11.

FIG. 6 shows a starting body 6', which is rotationally symmetrical in relation to the axis of rotation D and from which the adjustable rotary body 6 according to FIGS. 7 through 14 was manufactured. The starting body 6' has the same, regular wave contour on its surface everywhere along its axis of symmetry S. It may be obtained, e.g., by compression molding and sintering. It may also be obtained from a regular cylindrical casting by material-removing machining. The starting body 6' can be obtained by machining by clamping the previously smooth cylinder casting with its symmetry axis S as the axis of rotation into a lathe and by axially displacing a turning tool of the lathe along a template corresponding to the wave contour and forming the wave form as a result.

The starting body 6' thus obtained is clamped rotatably in a subsequent operation around a machining axis B offset in parallel to the symmetry axis S. The symmetry axis S is the central axis $L_7$ through the azimuths of the foot sections 7, and the machining axis B is the central axis $L_8$ through the azimuths of the head sections 8. The machining axis B therefore has an eccentricity "2e" compared with the symmetry axis S of the starting body 6'. The starting body 6' is subsequently rotated around the machining axis B. At the same time, the turning tool is displaced axially in a straight line along the machining axis B and moved toward the machining axis B, so that the asymmetrical, adjustable rotary body 6 is obtained after the hole 11 has been prepared.

FIG. 6 shows as an example the pitch of the wave contour of the starting body 6'. The pitch is the distance between two apices of the head sections 8 arranged next to each other, and likewise the axial distance between two apices of the foot sections 7 arranged next to each other, the distances being measured in the axial direction. This distance or the pitch equals one fourth of the width of a printing form being used in the current print run, which said width is measured in the axial direction. The pitch of the wave contour of the rotary body 6, which was obtained from the starting body 6', is therefore likewise one fourth of the width of the printing form.

The wave form of the rotary body 6 visible in FIGS. 7 through 14 is obtained because of the manufacturing process. The rotary body 6 according to the second exemplary embodiment has a wave contour that is uniformly round everywhere in the axial direction only along a single straight line, along which the radial height differences $H_D$ have their maxima. The waved contour with the maxima of the radial height differences $H_D$ can be recognized in the longitudinal views in FIGS. 7 and 14. A single, exact straight line, at which the minima of the radial height differences $H_D$ are consequently again "zero," is formed in a diametrically opposite location. Over the circumference between these two straight lines, the wave contours have straight plateaus in the axial direction in the apical areas of the head sections 8, as can be readily recognized from FIGS. 8 through 13. The two inner circles shown in the front views in FIGS. 7 through 14 are the azimuth of the foot sections 7, on the one hand, and the azimuth of the head sections 8, on the other hand. All the cross sections that are located in the axial direction between the azimuths of the foot sections 7 and the azimuths of the head sections 8 deviate from the circular shape corresponding to the manufacturing process. The transitions between the straight plateaus of the head sections 8 and the round, convex foot sections 7 are made round by machining preferably in the circumferential direction by fine surface finishing, e.g., by grinding and polishing.

The fluid channels 15 may have been prepared first only in the asymmetric rotary body 6. Furthermore, they may be prepared in the starting body 6' after the starting body 6' has been prepared, or, finally, they may also have been prepared already in the straight cylindrical, smooth casting as an alternative, if the starting body 6' was prepared from such a body.

The formation of a gas cushion, preferably an air cushion, between the web and the surface of the rotary body is highly advantageous in a rotationally symmetrical rotary body, as can be formed by the starting body 6'. The shape and the arrangement of the fluid channels 15 in the longitudinal direction and in the circumferential direction of the rotary body 6' may be the same as in the adjustable rotary body 6. The rotary body 6' may be mounted rotatably in order to reduce the friction with the wrapping web. However, it is also fully sufficient and even preferred for the rotary body 6' not to be mounted rotatably in the machine frame.

The formation of an air cushion or cushion from another gas is, furthermore, advantageous not only in connection with a one-piece rotary body 6 or 6', but also in the case of a rotary body formation made from a plurality of rollers arranged axially next to each other and, in principle, in other embodiments of rotary bodies as well. Concerning such other embodiments, which may be adjustable or nonadjustable but have the fluid admission to the surface of the rotary body according to the present invention, again refer to EP 1 101 721 A1, to which reference is also made in this respect. However, the embodiments made of one-piece rotary bodies or multipart rotary body formations described there would have to be provided with fluid channels and a fluid connection for the fluid channels in the jacket of the rotary body or in the jackets of the plurality of rotary bodies of a rotary body formation.

While specific embodiments of the invention have been shown and described in detail to illustrate the application of the principles of the invention, it will be understood that the invention may be embodied otherwise without departing from such principles.

What is claimed is:

1. A rotary body for compensating the fanout in a printing press, the rotary body comprising:

foot sections;

head sections projecting beyond said foot sections by radial height differences alternating adjacent to each other in a torsion-proof connection or in one piece along an axis of rotation, said radial height differences increasing in a circumferential direction from minima, which said radial height differences have along a first straight line of tangents offset in parallel to said axis of rotation, to maxima, which said radial height differences have along a second straight line of tangents offset in parallel to said axis of rotation.

2. A rotary body in accordance with claim 1, wherein the minima are equal.

3. A rotary body in accordance with claim 1, wherein the minima have no radial height differences.

4. A rotary body in accordance with claim 1, wherein the maxima are equal.

5. A rotary body in accordance with claim 1, wherein said foot sections form surface sections of an identical shape.

6. A rotary body in accordance with claim 1, wherein said head sections form said surface sections of identical shape.

7. A rotary body in accordance with claim 1, wherein said foot sections form radially outwardly concave surface sections.

8. A rotary body in accordance with claim 7, wherein said surface sections formed by said foot sections are continuous in the axial direction.

9. A rotary body in accordance with claim 7, wherein said surface sections formed by said foot sections are continuously differentiable in the axial direction.

10. A rotary body in accordance with claim 1, wherein said head sections form radially inwardly extending concave surface sections.

11. A rotary body in accordance with claim 10, wherein said surface sections formed by said head sections are continuous in the axial direction.

12. A rotary body in accordance with claim 10, wherein said surface sections formed by said head sections are continuously differentiable in the axial direction.

13. A rotary body in accordance with claim 1, wherein said foot sections form radially outwardly concave surface sections and said head sections form radially inwardly extending concave surface sections wherein said surface sections formed by said foot sections and said surface sections formed by said head sections pass continuously over into each other.

14. A rotary body in accordance with claim 13, wherein said surface sections formed by said foot sections and said surface sections formed by said head sections pass tangentially over into each other.

15. A rotary body in accordance with claim 1, wherein said radial height differences, which change in the circumferential direction around said axis of rotation, are continuously differentiable in the circumferential direction around the axis of rotation.

16. A rotary body in accordance with claim 1, wherein said radial height differences which change in the circumferential direction around said axis of rotation, are equal along said straight line tangents, which touch said head sections, and are parallel to said axis of rotation.

17. A rotary body in accordance with claim 1, wherein said foot sections and said head sections form surface sections, which meet each other on a neutral regular cylinder jacket surface, and the axis of rotation of the rotary body is a central longitudinal axis of said neutral regular cylinder jacket surface.

18. A rotary body in accordance with claim 17, wherein said foot sections form arcs of a surface wave contour of said rotary body radially under said neutral regular cylinder jacket surface and said head sections form arcs of a surface wave contour of said rotary body radially above said neutral regular cylinder jacket surface in the axial direction, and said arcs formed by said foot sections have the same shape in each axial section of said rotary body, which said axial section encloses said axis of rotation, as said arcs formed by said head sections when said arcs formed by said foot sections are folded to the side of the arcs formed by said head sections.

19. A rotary body in accordance with claim 1, wherein said rotary body is connected to a final control element of a control or regulating means for a controlled or regulated rotary adjusting movement around the axis of rotation.

20. A rotary body in accordance with claim 1, in combination with a printing press and web, wherein the rotary body is arranged in the printing press between an upstream printing gap and a downstream printing gap, in which said gaps said web passing through is printed on one after another in a print run, on one side of said web, and the rotary body is wrapped around by said web.

21. A rotary body in accordance with one claim 1, wherein the rotary body has fluid channels in the rotary body which form a plurality of opening sites on the surface of the rotary body to feed a fluid to the surface of the rotary body.

22. A rotary body in accordance with claim 21, wherein the rotary body has an inner cavity into which said fluid channels open.

23. A rotary body in accordance with claim 21, wherein at least some of said fluid channels comprise holes formed in the rotary body.

24. A rotary body in accordance with claim 21, wherein the rotary body comprises porous material defining said fluid channels.

25. A rotary body in accordance with claim 21, further comprising a hollow axle or hollow shaft, wherein the rotary body is mounted rotatably on said hollow axle or is fastened to said hollow shaft secured against rotation, said hollow shaft forming a fluid connection for said rotary body allowing fluid to be fed to said fluid channels through said hollow axle or said hollow shaft.

26. A rotary body in accordance with claim 1, wherein the rotary body is shaped in one piece in an original shaping or forming process or is obtained by joining to provide a torsion-proof connection of a plurality of parts thus formed.

27. A rotary body in accordance with claim 1, wherein said rotary body is obtained from a starting body that is rotationally symmetrical in relation to the axis of rotation with the starting body subjected to a material-removing machining with a tool, during which a relative movement takes place around a machining axis that is eccentric to the axis of rotation between said rotary body and the tool, and a radial distance between said machining axis and the tool is reduced.

28. A process for preparing a rotary body comprising foot sections and head sections projecting beyond said foot sections by radial height differences alternating adjacent to each other in a torsion-proof connection or in one piece along an axis of rotation, said radial height differences increasing in a circumferential direction from minima, which said radial height differences have along a first straight line of tangents offset in parallel to said axis of rotation, to maxima, which said radial height differences have along a second straight line of tangents offset in parallel to said axis of rotation, the process comprising:

providing a starting body which is rotationally symmetrical to the axis of rotation with a wave profile on a surface of the starting body, the wave profile having a final wave profile periodicity;

subjecting the starting body and a material-removing tool facing the surface of the starting body to a relative rotary movement around a machining axis offset in parallel to the axis of rotation with the radial distance between said machining axis and the tool being uniformly reduced along said machining axis during the relative rotary movement and material being removed as a result from the surface of said starting body.

* * * * *